United States Patent [19]

Lebelson

[11] 4,345,762

[45] Aug. 24, 1982

[54] ASSEMBLY TOY

[76] Inventor: Yaacov Lebelson, 24 Hahalutzim St., Tel Aviv, Israel

[21] Appl. No.: 207,872

[22] Filed: Nov. 18, 1980

[30] Foreign Application Priority Data

Dec. 3, 1979 [IL] Israel ..... 58844

[51] Int. Cl.[3] ..... A63F 9/12

[52] U.S. Cl. ..... 273/157 R; 46/24; 46/25; 46/31; 273/160

[58] Field of Search ..... 273/157 R, 160; 46/23, 46/25, 30

[56] References Cited

U.S. PATENT DOCUMENTS

| | | | |
|---|---|---|---|
| 2,699,128 | 1/1955 | Johnson | 46/25 UX |
| 2,913,137 | 11/1959 | Alatorne | 273/293 X |
| 3,032,919 | 5/1962 | Amsler | 46/25 X |
| 3,558,138 | 1/1971 | Lemelson | 273/157 R |
| 4,035,947 | 7/1977 | Burge | 46/25 |
| 4,050,184 | 9/1977 | Chiari | 46/23 X |
| 4,109,409 | 8/1978 | Fischer . | |
| 4,147,007 | 4/1979 | Eppich . | |

FOREIGN PATENT DOCUMENTS

| | | | |
|---|---|---|---|
| 508922 | 8/1920 | France | 46/25 |
| 506204 | 5/1939 | United Kingdom | 46/25 |
| 569624 | 6/1945 | United Kingdom | 273/160 |
| 740951 | 11/1955 | United Kingdom . | |
| 846151 | 8/1960 | United Kingdom | 46/25 |
| 1493934 | 11/1977 | United Kingdom | 273/157 R |

*Primary Examiner*—Anton O. Oechsle

*Attorney, Agent, or Firm*—Sandler & Greenblum

[57] ABSTRACT

An assembly toy comprising at least first and second elements, the first element having a male attachment protrusion disposed along an edge thereof and the second element having defined along an edge thereof a female socket, the protrusion and the socket being configured to permit selectable press fit and sliding engagement therebetween. Games and puzzles having a selectable attachment feature may be constructed with the first and second elements as well as three dimensional puzzles, games and figures.

14 Claims, 30 Drawing Figures

ASSEMBLY TOY

The present invention relates to assembly toys and more particularly to toys which enable varied structures to be constructed from one or more basic building elements.

Toys comprising removably attachable building blocks are very well known in the literature and enjoy immense popularity on the marketplace. One of the best known of such toys is Lego ® which involves a press fit attachment of one element to another. Other types of assembly toys are known using suction cups or clips for attachment. Most of the toys known to the present applicant are limited to one mode of attachment, i.e. press fitting, and are therefore limited in their structural adaptability, that is they cannot be readily employed to make many types of structures. Furthermore, the provision of only a single mode of attachment restricts the mode in which a structure can be dismantled and therefore sometimes limits the usefulness of the toy and the enjoyment that can be gained from playing therewith.

A number of other types of assembly toys are known in the patent literature. For example, U.S. Pat. No. 4,109,409 shows a building element which is suitable for slidable engagement only and not for press-fit engagement. Another example of a slidable engagement assembly toy is described in U.S. Pat. No. 4,035,947. A panel element assembly toy having a plurality of interengagable ribs along one flat surface thereof is described in U.S. Pat. No. 4,147,007. Panel elements having a single smooth face and requiring connectors for interconnection thereof are shown in U.S. Pat. No. 3,032,919. None of these patents discloses or suggests the provision of a dual mode connection, i.e. sliding and press fit.

The present invention provides an assembly toy having two modes of attachment, a press-fit mode and a sliding mode. It is suitable for relatively easy construction of a wide variety of types of structures in a rigid manner while permitting simple dismantling thereof.

There is thus provided in accordance with an embodiment of the present invention an assembly toy comprising at least first and second elements, the first element having a male attachment protrusion disposed along an edge thereof and the second element having defined along an edge thereof a female socket, the protrusion and the socket being configured to permit selectable press fit and sliding engagement therebetween.

Further in accordance with an embodiment of the present invention the first and second element comprise blocks having a pair of flat surfaces and the protrusions and sockets are arranged such that the flat surfaces of adjacent blocks define a continuous surface.

Additionally in accordance with an embodiment of the invention, the first and second elements may each comprise one or more of the protrusions and of the sockets.

Further in accordance with an embodiment of the invention there is provided a three dimensional puzzle comprising a pluraity of puzzle elements each having first and second surfaces and interconnection sockets; connector elements for interconnecting the puzzle elements at predetermined selected relative angular orientations such that the first surfaces of adjacent puzzle elements define an uninterrupted junction with each other.

The puzzle elements and connector elements may be configured to enable the puzzle elements to be joined in flat co-planar orientation or alternatively at 90-degree angles for constructing puzzle cubes, for example.

Further in accordance with an embodiment of the invention the elements may be constructed to have interchangeable faces or curved surfaces.

Still further in accordance with an embodiment of the present invention the blocks need not necessarily be flat but rather may define curved surfaces such as a cylindrical section and a spherical section.

The invention will be more fully understood and appreciated from the following detailed description taken in conjunction with the drawings in which.

Figure 1A:
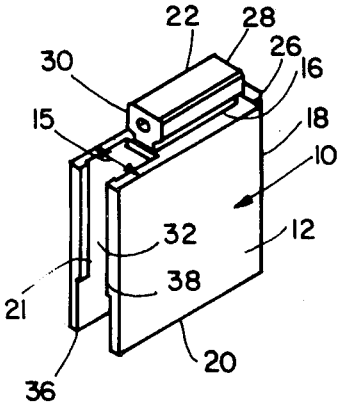
FIGS. 1A and 1B are pictorial views of an assembly toy building element constructed and operative in accordance with an embodiment of the present invention.
Figure 1B:
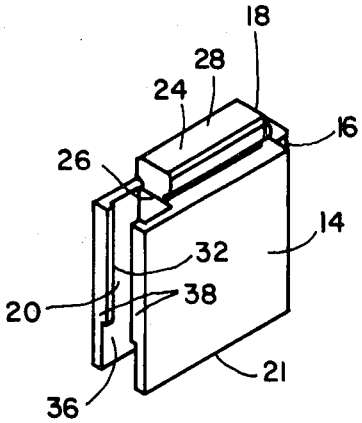

Reference is now made to FIGS. 1A and 1B which show a building element constructed and operative in accordance with an embodiment of the invention. The building element comprises a generally square central portion 10 having generally parallel flat opposite surfaces 12 and 14 which are separated by a thickness 15 typically 10 mm. The element defines four side edges 16, 18, 20 and 21. Disposed along adjacent edges 16 and 18 and protruding therefrom are respective joining protrusions 22 and 24 which are typically identical. Protrusions 22 and 24 typically comprise generally elongate bodies whose longitudinal axis lies parallel to the adjacent edge surface. Protrusions 22 and 24 are formed with a relatively narrow neck portion 26 and a relatively wider top portion 28 extending outwardly therefrom.

Protrusions 22 and 24 may be apertured or dimpled as indicated at 30 along their longitudinal axes to reduce the amount of plastic or other material used or to provide a rotational mounting socket at the dimples.

It is noted that the elements described herein are typically formed of a thermoplastic material such as plastic but may alternatively be formed of any suitable material.

It is a particular feature of the present invention that protrusions 22 and 24 have a uniform cross section along their length so as to permit a suitably formed socket to be slidably engaged or disengaged therefrom. It is also a particular feature of the invention that the difference in thickness between the neck portion and the wider top portion is sufficiently small so as to permit removable snap-on engagement and disengagement between the protrusion and a suitably formed corresponding socket. The pastic or other material must have sufficient elasticity to permit the snap-on engagement and disengagement.

Disposed along edges 20 and 21 and recessed with respect thereto are sockets 32 designed and configured for removable sliding and/or snap-fit or press-fit engagement with a protrusion such as protrusion 22 of a second element. The socket may extend along the entire edge or along only a portion thereof.

It is noted that although protrusions are formed on adjacent edges of the building element of FIGS. 1A and 1B, need not necessarily be the case, and protrusions and sockets may be disposed on respective opposite edges. As a further alternative, a building element such as the element illustrated in FIGS. 1A and 1B may be formed with an combination of protrusions or sockets, all protrusions or all sockets.

Considering sockets 32, it is noted that each socket comprises two generally flat side walls 36 defined by the walls which define surfaces 12 and 14. At the extreme outer edge of each of the side walls 36 there is formed an inner facing flange or undercut 38.

It may be appreciated that when socket 32 is in engagement with a protrusion such as protrusion 22, inner facing flanges 38 engage the neck portion 26. The construction of the socket is such that the flat side walls 36 are slightly bendable upon application of a reasonable force within the ability of a child, so as to permit the socket and the protrusion to be pressed onto each other, such that flanges 38 are spread sufficiently to allow passage of the top portion 28 therepast, and to be pulled apart in the same manner. As noted above, it is a particular feature of the invention that socket 32 and protrusion 22 or 24 may be slid relative to each other when flanges 38 engage the neck portion 26 for engagement or disengagement of the elements from each other.

It is to be appreciated that the precise shape of the protrusions and the sockets need not necessarily be identical to that illustrated herein, provided that both press fit engagement and sliding engagement are provided.

Figure 3:
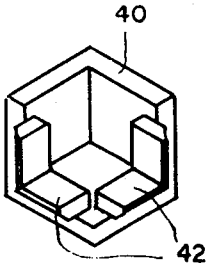
FIG. 3 is a corner finishing element for use with the element of FIG. 1.

Various other examples of finishing and joining members which can be used together with the element of FIGS. 1A and 1B will now be described briefly. FIG. 3 illustrates a corner finishing element having an outside portion 40 and a pair of right angle stop members 42 arranged for engagement with respective protrusions to engage their respective neck portions 26.

Figure 4:
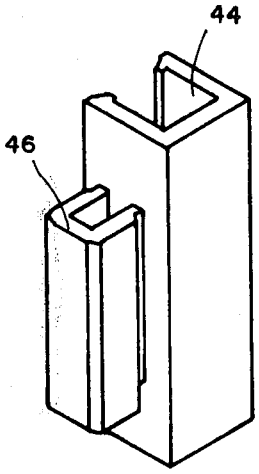
FIG. 4 is a finishing element for use in constructing joined perpendicular planes, as at a corner.

FIG. 4 shows a right angle corner connector comprising a socket member 44, identical to socket 32 and a protrusion 46 attached to a side wall thereof and extending at a right angle with respect thereto. This element is useful for constructing corners.

Figure 5:
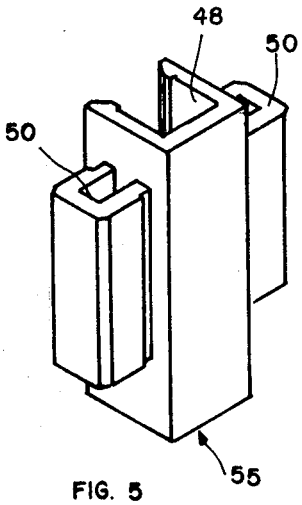
FIG. 5 is a two-sided finishing element for use in constructing joined perpendicular planes.

FIG. 5 shows a two sided version of the connector illustrated in FIG. 4 and comprises a socket member 48 having a pair of oppositely extending protrusions 50 disposed at right angles to the socket member. This element is useful in constructing a wall to ceiling joint, and is indicated by reference 55.

Figure 2:
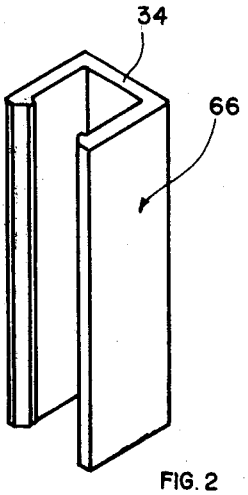
FIG. 2 is a female finishing element for use with the element of FIG. 1.
Figure 6:
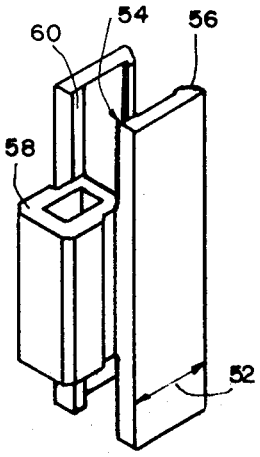
FIG. 6 is a spacer element for use in constructing a planar structure.

FIG. 6 is a combination socket and protrusion member which can be used as a spacer. The width 52 of the spacer is typically selected to be a fraction of the width of a standard element. The spacer, identified by reference numeral 54 comprises a socket 56 and a protrusion 58. Here the socket is formed with an open bottom portion 60 in place of a bottom wall 34 (FIG. 2).

Figure 7:
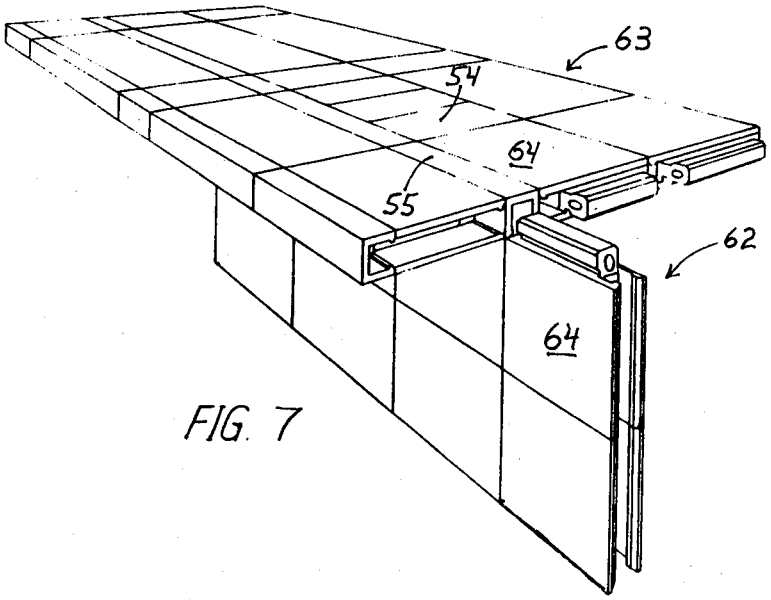
FIG. 7 is is pictorial illustration of a wall and ceiling construction using the elements of the present invention.
Figure 8:
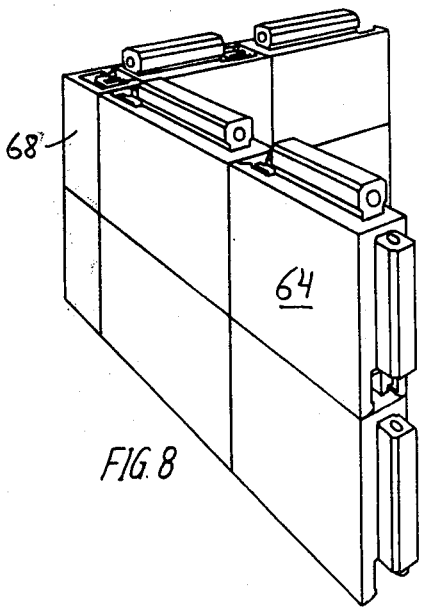
FIG. 8 is a pictorial illustration of a corner construction using the elements of the present invention.

Two examples of basic constructions which can be made with the elements described hereinabove are illustrated in FIGS. 7 and 8. In FIG. 7 there is shown a wall and ceiling construction comprising a wall 62 formed of basic elements 64 and a ceiling 63 formed of elements 55 which are in turn joined to basic elements 64. The use of socket elements such as finishing element 66 of FIG. 2 is also shown as is the use of spacers 54.

FIG. 8 illustrates the construction of a right angle corner using basic elements 64 which are joined at the corner by right angle corner connectors 68 as shown in FIG. 4.

It is appreciated that a wide variety of constructions, not limited necessarily to right angle constructions may be produced using suitable elements constructed in accordance with an embodiment of the invention.

The various constructions have the significant advantage that they can be made or taken apart either by pressing-pulling or by sliding, thus displaying a relatively wide range of possible variations of constructional technique and results.

In accordance with an alternative embodiment of the present invention the various elements described hereinabove in the shapes illustrated or in any other suitable shape may be used to construct a flat or three dimensional puzzle. The major advantage of the puzzle constructed and operative in accordance with the present invention is that the puzzle tends to stay together rather than falling apart when disturbed. In addition to this advantage is the ability to construct a three dimensional puzzle which was impossible with prior art non-joining puzzle pieces.

The puzzle may be formed by providing portions of a picture or any other indicia on the flat surfaces of the various elements. Such indicia may be provided on one or both such surfaces or alternatively coding indicia may be providing on a back surface. The pieces may be dedicated to a particular place in a particular pattern or may have general application to a number of possible places or locations on a puzzle.

Additionally in accordance with an embodiment of the present invention, there is provided a mosaic toy comprising a plurality of elements of the type described above which are characterized by color or any other suitable indicia and may be selectably joined together in a desired pattern to create an image. The image may be two-dimensional or three dimensional.

According to an alternative embodiment of the invention, the surfaces of the elements need not necessarily be flat but may instead by curved or formed in any other suitable shape including a moulded fanciful shape.

Figure 9A:
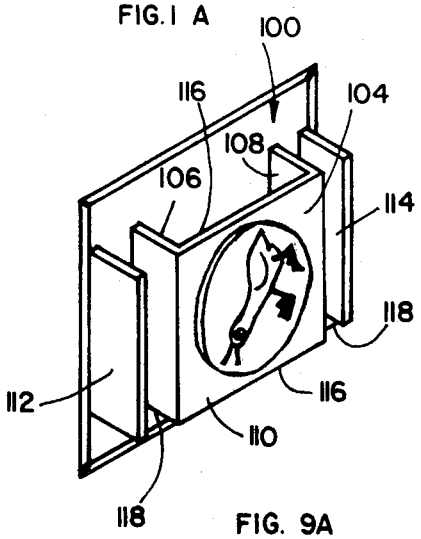
FIGS. 9A and 9B are pictorial illustrations of opposite sides of puzzle elements constructed and operative in accordance with an embodiment of the present invention.
Figure 9B:
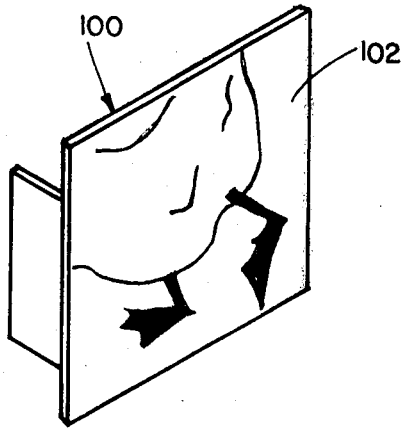

Reference is now made to FIGS. 9A and 9B which illustrate a three-dimensional puzzle element 100, bearing on an outer surface 102 thereof a portion of a pattern or design. The back portion of the puzzle element is formed with a centrally disposed arch member 104 comprising a pair of parallel spaced upstanding portions 106 and 108 joined by a generally flat planar member 110 disposed in spaced parallel disposition to surface 102. Disposed in spaced generally parallel disposition to upstanding portions 106 and 108 are a pair of additional upstanding elements 112 and 114 which form sockets in cooperation with corresponding respective portions 106 and 108 and which may be formed with appropriate undercutting or edge protrusions (not shown) to enhance attachment.

It is a particular feature of the present invention that there may be formed, as by moulding or stamping, a code indication on member 110 indicating the image shown on surface 102 or the class to which it belongs. This code indication may be conveniently produced by applying an appropriate die to the end of a pusher rod which ejects the moulded element from an injection moulding or other moulding machine.

It may be appreciated that in order to minimize the effect of overlapping edges, the puzzle pieces may be formed of relatively thin materials or made with mitered edges.

It may be appreciated that arch members 104 form female sockets 116 at their open ends as well as sockets 118 between respective pairs of upstanding portions 106, 112 and 108, 114.

Figure 22A:
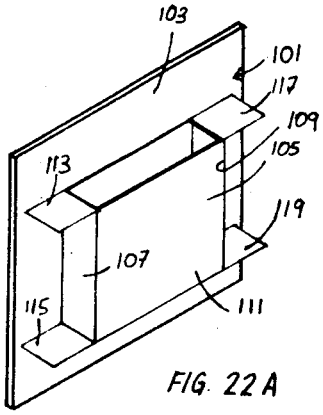
FIGS. 22A–22F are pictorial illustrations of puzzle elements constructed and operative in accordance with an alternative embodiment of the invention and connectors therefor.
Figure 22B:
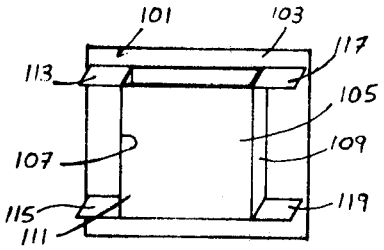
Figure 22C:
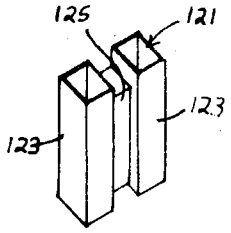

Reference is now made to FIGS. 22A–22F, which illustrate a puzzle element and connectors therefor constructed and operative in accordance with an alternative embodiment of the invention. FIGS. 22A and 22B illustrate in respective perspective and plan views a puzzle element 101 comprising an outer surface member 103 and a centrally disposed arch member 105 comprising a pair of parallel spaced upstanding portions 107 and 109 joined by a generally flat planar member 111 disposed in spaced parallel disposition to surface 103. Disposed in spaced generally perpendicular to upstanding portions 107 and 109 are four additional upstanding elements 113, 115, 117, and 119 at the four corners of the element which define sockets between respective pairs of elements 113 and 115 on the one hand and 117 and 119 on the other hand.

A connector 121, such as the connector illustrated in FIG. 22A may be used for connecting two puzzle elements 101 in relative right angle orientation. The connector comprises two cylinders 123 each of square cross section which are joined along facing longitudinal edges by a joining portion 125. The ends of cylinders 123 may be formed with raised peripheral edge portions 125 for enhanced retention by elements 113–119.

Figure 22D:
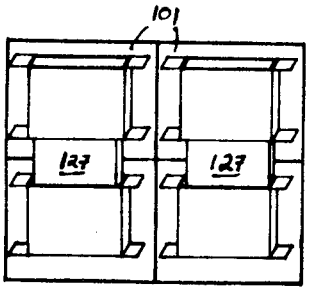
Figure 22F:
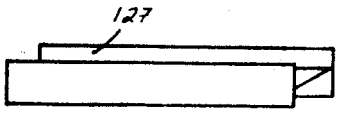
Figure 22E:
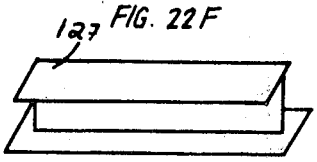

FIG. 22D shows four elements 101 joined in parallel coplanar arrangement by a plurality of elongate connectors 127, which are illustrated in FIGS. 22E and 22F. The elements are additionally joined by a plurality of connectors 121, which are not shown in FIG. 22D but are nonetheless needed when more than two elements 101 are coupled in coplanar arrangement.

Figure 10:
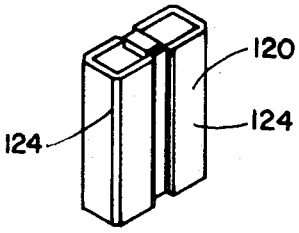
FIGS. 10 and 11 are pictorial illustrations of two different types of connections useful with the puzzle elements of FIGS. 9A and 9B.
Figure 11:
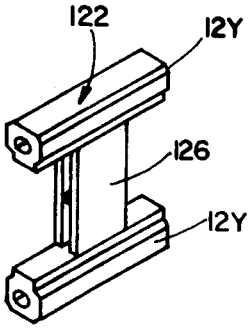

Reference is now made to FIGS. 10 and 11 which illustrate two types of connecting elements, 120 and 122. Connector 120 is employed for connecting two puzzle elements 100 at right angles, engaging a socket 116 of one element and a socket 118 of a second element. Connectors 122 are used for connecting a pair of puzzle elements in a coplanar arrangement, engaging sockets 116 of each of the puzzle elements. It is noted that connector 120 comprises a pair of generally rectangular portions 124 which are joined by a narrower portion defining an undercut. Connector 122 comprises identical portions 124 which are separated by a joining rod 126.

Figure 12A:
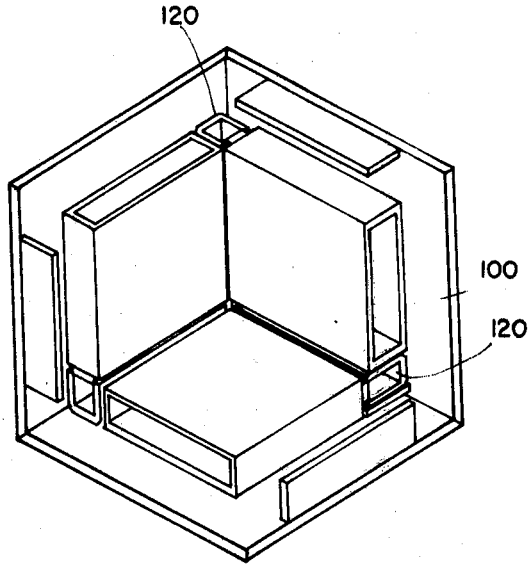
FIGS. 12A and 12B are respective inside and outside pictorial views of a puzzle cube constructed using the puzzle elements of FIGS. 9A and 9B and the connector of FIG. 10.
Figure 12B:
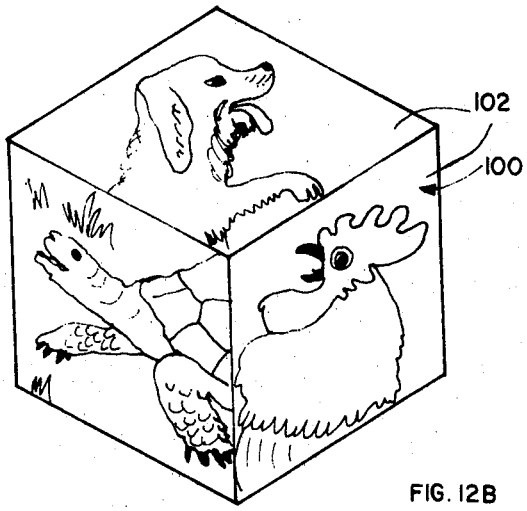

FIGS. 12A and 12B illustrate inside and outside views of a six sided puzzle block constructed of puzzle elements 100 joined by connectors 120. It is noted that surfaces 102 of the respective puzzle elements define uninterrupted junctions, and each surface 102 contains a portion of a different image.

Figure 13:
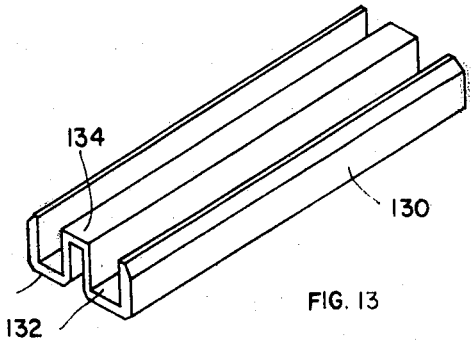
FIG. 13 is a pictorial view of a connector useful for connecting a plurality of the puzzle elements of FIGS. 9A and 9B in a homoplanar array.

FIG. 13 shows a further type of connector 130 which is employed to join two or four puzzle elements 100 in a coplanar arrangement, by engagement of respective adjacent sockets 118 of the puzzle elements. Connector 130 comprises a pair of one-sided protrusions 132 which are joined by a joining member 134 of width sufficient to accomodate the width of a pair of adjacent upstanding elements.

Figure 14:
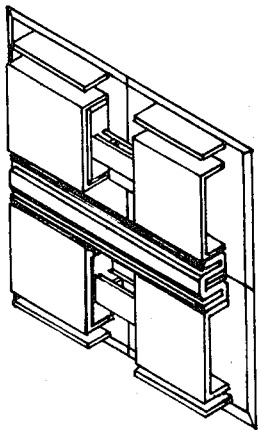
FIG. 14 is a pictorial back view of four puzzle elements joined in a homoplanar array by means of the connectors of FIGS. 11 and 13.

An arrangement of four puzzle elements 100 joined by connectors 130 and 122 is illustrated in FIG. 14.

It is appreciated that the locations of sockets and protrusions in the building and puzzle elements may be interchanged. It is also appreciated that three dimensional puzzles may be constructed with the building elements described herein and vice versa.

Figure 15:
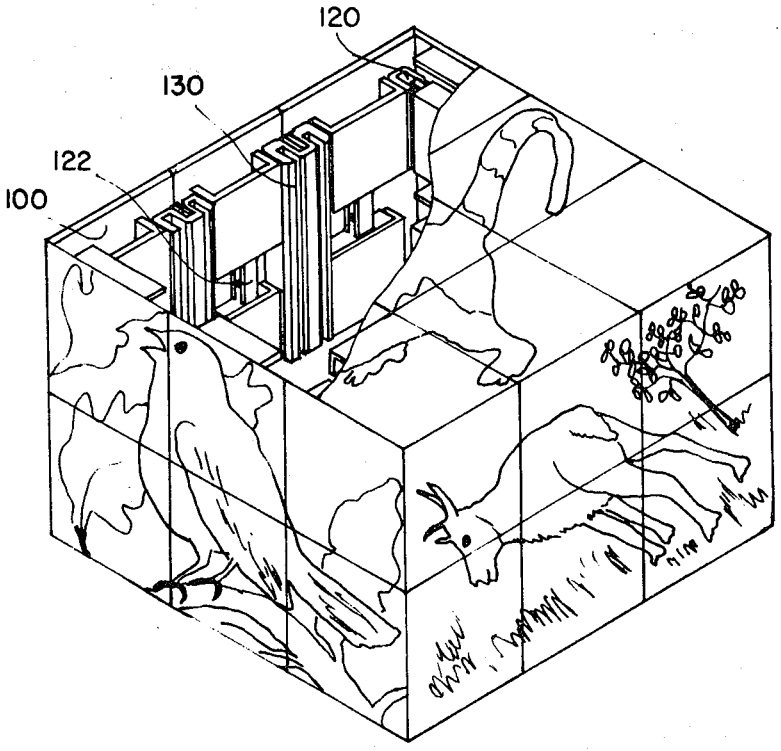
FIG. 15 shows a large puzzle block constructed of the puzzle elements of FIGS. 9A and 9B and the connectors of FIGS. 10, 11 and 13.

FIG. 15 shows a large puzzle block which may be formed by forming the puzzle images in planar form, as by joining the puzzle elements corresponding to a single image by means of connectors 122 and 130, and then joining the planar images at right angles by means of connectors 120 to form a large puzzle block, each face of which bears a complete image. It is appreciated that the images may be formed of any desired number of puzzle elements. In the illustrated embodiment each image is formed by six puzzle elements, corresponding to the six sides of the basic puzzle cube illustrated in FIGS. 12A and 12B.

Figure 16:
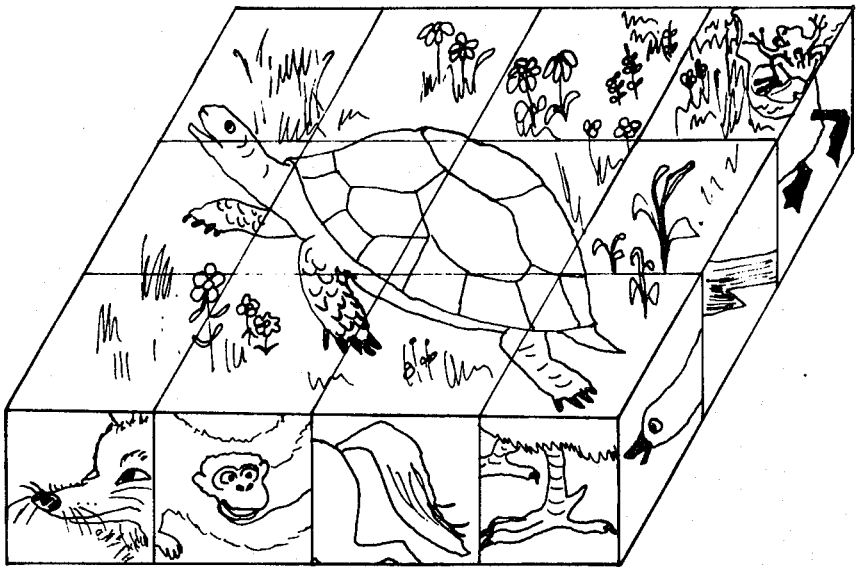
FIG. 16 is a pictorial illustration of a puzzle formed of a plurality of puzzle cubes as shown in FIGS. 12A and 12B.

FIG. 16 shows a plurality of puzzle cubes arranged to form an image formed of 12 elements. It may be appreciated that some of the puzzle elements may form part of more than one image, but this need not necessarily be the case.

Figure 17:
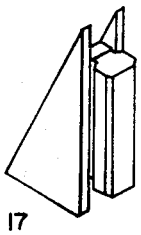
FIGS. 17 and 18 illustrate two different forms of triangular building elements.
Figure 18:
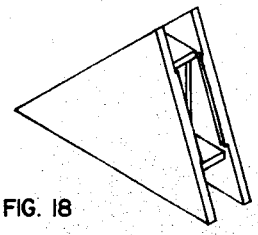
Figure 19:
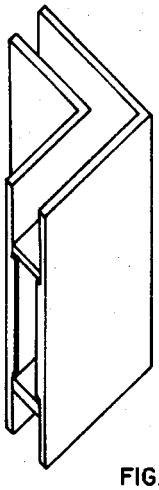
FIG. 19 is a pictorial illustration of a corner building element.
Figure 20:
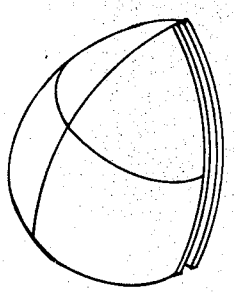
FIG. 20 is a pictorial illustration of a plurality of curved building elements joined together to form a spherical section.

FIGS. 17 and 18 show two types of triangular building or puzzle elements which interface with the elements of FIGS. 1A and 1B. They may be used, for example, as sides of pyramids or peaks of roofs, respectively. FIG. 19 shows a corner element which interfaces with the elements of FIGS. 1A and 1B and is useful for defining corners in three dimensional structures. FIG. 20 shows curved elements constructed with sockets and protrusions permitting sliding and snap-fit engagement which are joined to define a curved segment.

Figure 21:
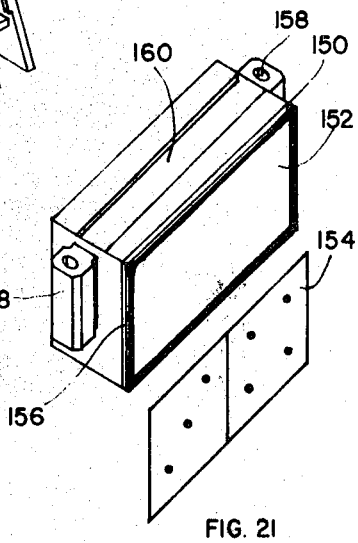
FIG. 21 is a pictorial illustration of a building element having an interchangeable face.

Reference is now made to FIG. 21 which illustrates a multipurpose puzzle or building block 150 which is arranged to receive an interchangeable surface pattern or indicia. According to a preferred embodiment of the invention, the block 150 is formed with an open or transparent front face 152 having a recess formed therebehind. A pattern sheet 154 may be inserted behind front face 152 in viewable disposition through a slit 156 formed in the side wall of the block 150.

Block 150 is typically formed with protrusions 158 at the ends thereof and an elongate female socket 160 along the top and bottom edge surfaces thereof for accomodating the protrusions 158 in right-angled engagement. Alternatively any other suitable arrangement of protrusions and sockets may be provided.

Blocks 150 may be employed for use in a variety of games such as dominoes with pictures, letters, numbers, dots shapes or any other indicia. The blocks may also be the basis of a puzzle with interchangeable themes.

It is noted specifically that blocks 150 as well as the elements illustrated in FIGS. 1A and 1B may be employed as the basis for a SCRABBLE® type of word game which is characterized by the feature that the letter bearing elements are removably joinable to each other in two or three dimensional arrangements.

The invention is not limited to what has been specifically shown and described hereinable for the purposes of exemplary illustration. Rather the scope of the invention is defined only by the claims which follow:

I claim:

1. An assembly toy comprising at least first and second elements, said first element having a male attachment protrusion disposed along an edge thereof and said second element having defined along an edge thereof a female socket, the protrusion and the socket being configured to permit selectable press fit and slidable engagement therebetween;

said at least first and second elements each being formed of a pair of parallel disposed flat surfaces arranged in generally co-extensive spaced relationship and defining first, second, third and fourth edges;

said pair of surfaces being joined along at least part of said first and second edges and being separated from each other along said third and fourth edges thereby to permit flexibility between said pair of surfaces at said third and fourth edges;

said male attachment protrusion being disposed along said first edges and defining a generally elongate protrusion including an end portion having generally parallel planar side protrusion surfaces extending parallel to said pair of surfaces and a narrowed neck portion joining said end portion to said first edge;

said female socket being defined by said pair of surfaces at said third edges, said female socket also comprising flange means extending inwardly from said pair of surfaces for selectable retaining of said male attachment protrusion, at least one of said protrusion and flange means including bevelled surfaces being so directed as to enable ready press fit engagement and disengagement of said protrusion and socket during generally coplanar motion therebetween.

2. An assembly toy according to claim 1 and wherein said protrusion and socket are arranged such that said elements define a continuous surface when engaged.

3. An assembly toy according to claim 1 and wherein at least one of said first and second elements comprises at least one protrusion and at least one socket.

4. An assembly toy according to claim 1 and wherein said first element comprises a pair of said protrusions and a pair of said sockets.

5. An assembly toy according to claim 1;

wherein said flange means defines a separation between said pair of surfaces which is normally narrower than the width of the end portion of said male attachment protrusion;

said socket portion being configured for sliding engagement with said protrusion;

said socket being formed with sufficient elasticity so as to permit press fit engagement between the socket portion and the protrusion.

6. An assembly toy according to claim 1 and wherein said first element comprises a plurality of male attachment protrusions.

7. An assembly toy according to claim 1 and wherein said second element comprises a plurality of said sockets.

8. An assembly toy according to claim 1 and wherein said at least two elements bear portions of an illustration on at least one surface thereof, such that interengagement of said at least two elements defines the illustration, such that said at least two elements each define pieces of a slidable or press fit engagement puzzle.

9. A three dimensional puzzle comprising a plurality of elements according to claim 1, each element bearing matchable indicia and which may be joined together to form a stable structure.

10. A three dimensional puzzle comprising a plurality of elements according to claim 1, said elements bearing indicia which can be spatially matched with indicia on other elements to form an image, such that a three dimensional free standing stable image can be produced by joining said elements either by press fitting or by sliding.

11. Assembly toy apparatus according to claim 1 and wherein said elements have interchangeable face indicia.

12. Assembly toy apparatus according to claim 11 and wherein said elements have a transparent front face and a slit disposed therebehind to accomodate said interchangeable face indicia.

13. Assembly toy apparatus according to claim 1 and wherein one of said surfaces is formed with domino indicia.

14. An assembly toy according to claim 1 wherein said protrusion and socket are arranged to permit flush side by side sliding or press fit attachment of said first and second elements to define a continuous surface.

* * * * *